US005405685A

United States Patent [19]

Patel

[11] Patent Number: 5,405,685

[45] Date of Patent: Apr. 11, 1995

[54] PAPERMACHINE CLOTHING

[75] Inventor: Sanjay R. Patel, Summerville, S.C.

[73] Assignee: Scapa Group PLC, Blackburn, United Kingdom

[21] Appl. No.: 245,273

[22] Filed: May 18, 1994

[51] Int. Cl.[6] ..... D03D 15/12; D03D 25/00; D21F 3/02

[52] U.S. Cl. ..... 428/229; 139/420 A; 139/383 A; 162/358.4; 162/900

[58] Field of Search ..... 139/420 A, 383 A; 162/358.4, 900; 428/229

[56] References Cited

PUBLICATIONS

*Chemical Abstracts:* 94–013022/02.

*Chemical Abstracts:* 93–113192/14.

*Chemical Abstracts:* 92–222366/27.

*Chemical Abstracts:* 92–187457/23.

*Chemical Abstracts:* 92–187455/23.

*Chemical Abstracts:* 92–059291/08.

*Primary Examiner*—James C. Cannon

*Attorney, Agent, or Firm*—Keck, Mahin & Cate

[57] ABSTRACT

Papermachine clothing for use in the forming, pressing or drying sections of a papermachine including fibres of polyethylene naphthalate polymer which provides excellent hydrolysis and heat resistance as well as good mechanical properties such as tensile strength, tenacity, elongation and flexibility.

4 Claims, No Drawings

PAPERMACHINE CLOTHING

The present invention relates to papermachine clothing for use in the forming, pressing or drying sections of a papermaking machine. The papermachine clothing of the invention has particular application as a dryer fabric.

Papermachine clothing generally comprises felts made from polyester monofilaments of 0.4 to 0.7mm diameter. These felts typically operate at a cylinder surface temperature of 120° to 130° C. More modern machines, however, operate at temperatures as high as 150° C., which in combination with the high water content of the surrounding atmosphere resulting from evaporation of water from the paper web, accelerates the scission by hydrolysis of the polyester linkages, resulting in premature failure of the fabrics. For example, a 20° to 30° C. rise in cylinder temperature may result in a life expectancy decrease in the order of 9 months for a typical dryer fabric.

This problem is particularly prominent with fabrics made from polyethylene terephthalate (PET), the industry standard. In order to improve the hydrolysis resistance of PET a mono- or biscarbodiimide stabiliser, such as N,N$^1$-di-2,6-diisopropylphenyl carbodiimide, is added to the melt during extrusion to block free carboxyl end groups. The carbodiimide also scavenges any water that penetrates the PET fibre through non-crystalline regions of the polymer chain. Such carboxyl groups would otherwise act as a catalyst for the hydrolysis reaction. However, the increase in cylinder operating temperatures has rendered this treatment less effective and there further exists the possibility of problems of toxicity associated with carbodiimide migration and volatilisation, particularly where the fabric is being used to prepare paper material for food packaging applications.

One possible alternative to PET is described in U.S. Pat. No. 5,169,499 which describes the use of copolymers of 1,4-dimethylolcyclohexane, terephthalic acid and isophthalic acid (PCTA) in papermachine clothing. PCTA in combination with stabilisers exhibits good hydrolysis resistance, but shows poor loop and knot strength and poor dry heat resistance. Possible alternatives such as polyetheretherketone and polyaryletherketones exhibit excellent hydrolysis resistance and tenacity but are vastly more expensive to produce. Further possible alternatives such as polyamides are disadvantageous on account of their poor hydrolysis resistance and aramids have a high fibrillation tendency. Polyphenylene sulphides and polyimides are unsuitable on account of their high cost.

It is an object of the present invention to provide papermachine clothing and particularly but not exclusively, papermachine fabric made from fibres having good hydrolysis resistance while retaining good overall strength, tenacity, flexibility as well as being cheap and readily available.

The present invention provides papermaking machine clothing suitable for use in the forming, pressing or drying sections of a papermaking machine, the clothing including a fibre structure, wherein the fibres of said structure comprise polyethylene naphthalate.

For the purposes of the present invention the term fibre refers to a shaped polymeric body capable of being formed with two or three dimensional articles as in woven or non-woven fabrics.

Polyethylene naphthalate (PEN) provides excellent hydrolysis and dry heat resistance and good mechanical properties such as tensile strength, tenacity, elongation and flexibility.

No carbodiimide stabilisers are required. However, stabilisers may be added. Furthermore PEN may be provided in a blend with other polymers, the blends optionally containing stabilisers.

PEN is a copolymer of 1,2-diethylene glycol and 2,6-naphthalene dicarboxcylic acid. PEN fibres can be prepared by drying pellets of PEN and then extruding using a single screw extruder with a die head temperature of 310° C. and a spinneret temperature of 300° C. to give as-spun monofilaments having a diameter of about 1.1 mm. The monofilaments can then be drawn by various known methods, for example through a heated oil bath, to a draw ratio of 6.0 to give monofilaments of 0.5 mm diameter.

In an example a 0.2 mm diameter PEN monofilament was found to have a strength retention of 63% after 10 days at 120° C. in a saturated water atmosphere compared with 45% for a stabilised 0.2 mm PET monofilament and 29% for a non-stabilised 0.2 mm PET monofilament. PEN shows better strength retention than PET. PEN also exhibits superior thermal properties as shown by its glass transition temperature of 123° C. and melting point of 268° C. compared with 80° and 255° C. respectively for PET. Furthermore PEN has far superior tensile strength and heat stability than PCTA.

I claim:

1. An article of papermachine clothing used in the forming, pressing or drying sections of a papermaking machine, which article includes a fibre structure, characterised in that the fibres of said structure consist essentially of polyethylene naphthalate.

2. An article of papermachine clothing as claimed in claim 1, wherein the fibres are free of carbodiimide stabilisers.

3. An article of papermachine clothing as claimed in claim 1, wherein the melting point of the fibres is 268° C.

4. An article of papermachine clothing as claimed in claim 1, wherein the glass transition temperature of the fibres is 123° C.

* * * * *

US005405685B1

REEXAMINATION CERTIFICATE (3627th)

United States Patent [19] [11] B1 5,405,685

Patel [45] Certificate Issued Sep. 15, 1998

[54] PAPERMACHINE CLOTHING

[75] Inventor: Sanjay R. Patel, Summerville, S.C.

[73] Assignee: Scapa Group PLC, Blackburn, United Kingdom

Reexamination Request:
No. 90/004,469, Nov. 26, 1996

Reexamination Certificate for:

| | |
|---|---|
| Patent No.: | **5,405,685** |
| Issued: | **Apr. 11, 1995** |
| Appl. No.: | **245,273** |
| Filed: | **May 18, 1994** |

[51] Int. Cl.[6] ..... D03D 15/12; D03D 25/00; D21F 3/02

[52] U.S. Cl. ..... 442/324; 139/383 A; 139/420 A; 162/358.4; 162/900; 442/414

[58] Field of Search ..... 442/302, 324, 442/414; 162/900, 902, 903, 348, 358.4; 139/383 A, 420 A

[56] References Cited

U.S. PATENT DOCUMENTS

| | | |
|---|---|---|
| 4,001,479 | 1/1977 | Hamana et al. . |
| 4,060,516 | 11/1977 | Kuratsuji et al. . |
| 5,169,499 | 12/1992 | Eagles et al. . |

*Primary Examiner*—Christopher W. Raimund

[57] ABSTRACT

Papermachine clothing for use in the forming, pressing or drying sections of a papermachine including fibres of polyethylene naphthalate polymer which provides excellent hydrolysis and heat resistance as well as good mechanical properties such as tensile strength, tenacity, elongation and flexibility.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4 are cancelled.

* * * * *